US008162452B2

(12) United States Patent
Kaga

(10) Patent No.: US 8,162,452 B2
(45) Date of Patent: Apr. 24, 2012

(54) LIQUID DISCHARGE DEVICE

(75) Inventor: Hikaru Kaga, Aisai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1063 days.

(21) Appl. No.: 12/005,724

(22) Filed: Dec. 28, 2007

(65) Prior Publication Data

US 2008/0158311 A1 Jul. 3, 2008

(30) Foreign Application Priority Data

Dec. 29, 2006 (JP) ..... 2006-356901

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85

See application file for complete search history.

(56) References Cited

U.S. PATENT DOCUMENTS

| | | | | |
|---|---|---|---|---|
| 5,963,237 | A | 10/1999 | Ikkatai et al. | |
| 6,022,102 | A | 2/2000 | Ikkatai et al. | |
| 6,276,784 | B1 | 8/2001 | Ikkatai et al. | |
| 6,390,611 | B1 | 5/2002 | Kobayashi et al. | |
| 6,866,372 | B2 * | 3/2005 | Oda et al. | 347/85 |
| 6,966,641 | B2 | 11/2005 | Taniguchi et al. | |
| 6,991,325 | B2 * | 1/2006 | Oda et al. | 347/85 |
| 2003/0038865 | A1 | 2/2003 | Inamura | |
| 2005/0212874 | A1 * | 9/2005 | Nomura et al. | 347/84 |
| 2006/0028519 | A1 | 2/2006 | Nakamura et al. | |
| 2006/0170739 | A1 | 8/2006 | Koga et al. | |

(Continued)

FOREIGN PATENT DOCUMENTS

| | | |
|---|---|---|
| JP | 10-029318 | 2/1998 |

(Continued)

OTHER PUBLICATIONS

U.S. Office Action for U.S. Appl. No. 12/005,758; filed Dec. 28, 2007; dated Nov. 22, 2011.

*Primary Examiner* — Matthew Luu
*Assistant Examiner* — Jannelle M Lebron
(74) *Attorney, Agent, or Firm* — Frommer Lawrence & Haug LLP

(57) ABSTRACT

A liquid discharge device may be provided with a discharge head, a sub tank comprising a first member; and a liquid replenishment device comprising a second member to be connected to a main tank. The second member is capable of being connected to and disconnected from the first member. The liquid within the main tank is supplied to the sub tank when the second member is in a connected state with the first member. The first member comprises a first liquid path and a first valve biased in a direction where the first liquid path is closed. The second member comprises a second liquid path and a second valve biased in a direction where the second liquid path is closed. The first member and the second member may be configured to open the second liquid path first, and then open the first liquid path in a case where the second member is to be connected to the first member. The first member and the second member may be configured to close the first liquid path first, and then close the second liquid path in a case where the second member is to be disconnected from the first member.

11 Claims, 12 Drawing Sheets

U.S. PATENT DOCUMENTS

| | | | |
|---|---|---|---|
| 2007/0115329 | A1 | 5/2007 | Takatsuka |

FOREIGN PATENT DOCUMENTS

| | | |
|---|---|---|
| JP | 10-309806 | 11/1998 |
| JP | 2000-343722 | 12/2000 |
| JP | 2002-154218 | 5/2002 |
| JP | 2002190677 | 7/2002 |
| JP | 2002-361894 | 12/2002 |
| JP | 2003001848 | 1/2003 |
| JP | 2003-053996 | 2/2003 |
| JP | 2005-41140 | 2/2005 |
| JP | 2005153387 | 6/2005 |
| JP | 2006-205690 | 8/2006 |

* cited by examiner

LIQUID DISCHARGE DEVICE

CROSS-REFERENCE TO RELATED APPLICATION

This application claims priority to Japanese Patent Application No. 2006-356901, filed on Dec. 29, 2006, the contents of which are hereby incorporated by reference into the present application.

BACKGROUND OF THE INVENTION

1. Field of the Invention

The technique taught in the present specification relates to a liquid discharge device. This technique relates to, for example, an ink jet recording device that records an image onto a recording medium by discharging ink from a discharge head.

2. Description of the Related Art

An ink jet recording device of station supply type is taught in, for example, US Patent Application Publication No. 2006/0170739. The ink jet recording device is provided with a discharge head that has nozzles, a sub tank that stores ink to be supplied to the discharge head, and a main tank that stores ink to be supplied to the sub tank. In the case where it has become necessary to replenish ink into the sub tank, the main tank is connected with the sub tank via an ink supply tube. The ink within the sub tank can thus be replenished from the main tank.

BRIEF SUMMARY OF THE INVENTION

The present inventor discovered that a large pressure change may be formed within the sub tank when the sub tank and the main tank are connected and/or disconnected. There is a possibility that a meniscus in a nozzle of the discharge head connected with the sub tank will be destroyed in a case where a large pressure change is formed within the sub tank. The technique taught in the present specification may suppress the formation of a large pressure change within the sub tank when the sub tank and the main tank are connected and/or disconnected.

One technique taught in the present specification is a liquid discharge device. This liquid discharge device may comprise a discharge head, a sub tank, and a liquid replenishment device. The sub tank may comprise a first member. The liquid replenishment device may comprise a second member to be connected to a main tank. The second member is capable of being connected to and disconnected from the first member. The liquid within the main tank is to be supplied to the sub tank when the second member is in a connected state with the first member. The first member may comprise a first liquid path and a first valve biased in a direction where the first liquid path is closed. The second member may comprise a second liquid path and a second valve biased in a direction where the second liquid path is closed. The first member and the second member may be configured to open the second liquid path first, and then open the first liquid path in a case for example where the second member is to be connected to the first member. With this configuration, pressure that is formed between the first member and the second member passes into the second liquid path that has been opened first. The pressure can thus be prevented from passing into the first liquid path, and the formation of a large pressure change within the sub tank can be prevented. Further, the first member and the second member may be configured to close the first liquid path first, and then close the second liquid path in a case for example where the second member is to be disconnected from the first member. Since the first liquid path is closed first, pressure that is formed between the first member and the second member can be prevented from passing into the first liquid path, and the formation of a large pressure change within the sub tank can be prevented.

DETAILED DESCRIPTION OF THE PREFERRED EMBODIMENTS

First Embodiment

Figure 1:
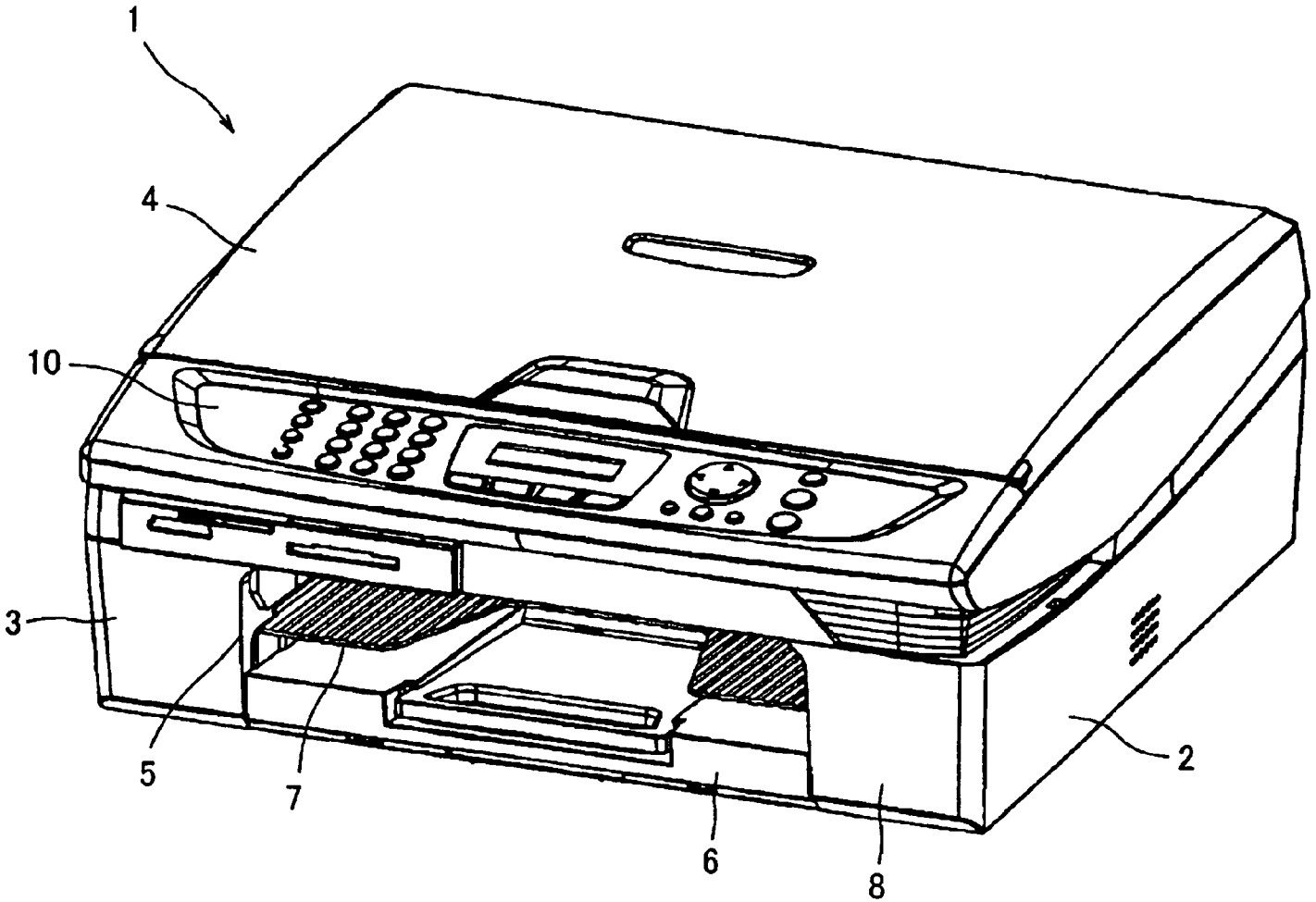
FIG. 1 shows a perspective view of a multi function device provided with an ink jet recording device.

FIG. 1 shows a perspective view of a multi function device 1 provided with an ink jet recording device 3. The multi function device 1 has a printer function, scanner function, copy function, and facsimile function. The multi function device 1 has a casing 2, the ink jet recording device 3 disposed within a lower part of the casing 2, and a scanner device 4 disposed within an upper part of the casing 2. An opening 5 is formed in a front surface of the casing 2. A paper supply tray 6 of the ink jet recording device 3 is disposed in a lower part of the opening 5. A paper discharge tray 7 of the ink jet recording device 3 is disposed in an upper part of the opening 5. An opening and closing cover 8 is formed at a lower right side of a front surface side of the ink jet recording device 3. A main tank mounting part 9 (see FIG. 3) is formed at an inner side of the opening and closing cover 8. An operation panel 10 for operating the ink jet recording device 3, the scanner device 4, etc. is formed at an upper part of a front surface side of the multi function device 1. Further, in the case where an external computer is connected, the multi function device 1 is capable of operating on the basis of commands transmitted from the computer via a driver.

Figure 2:
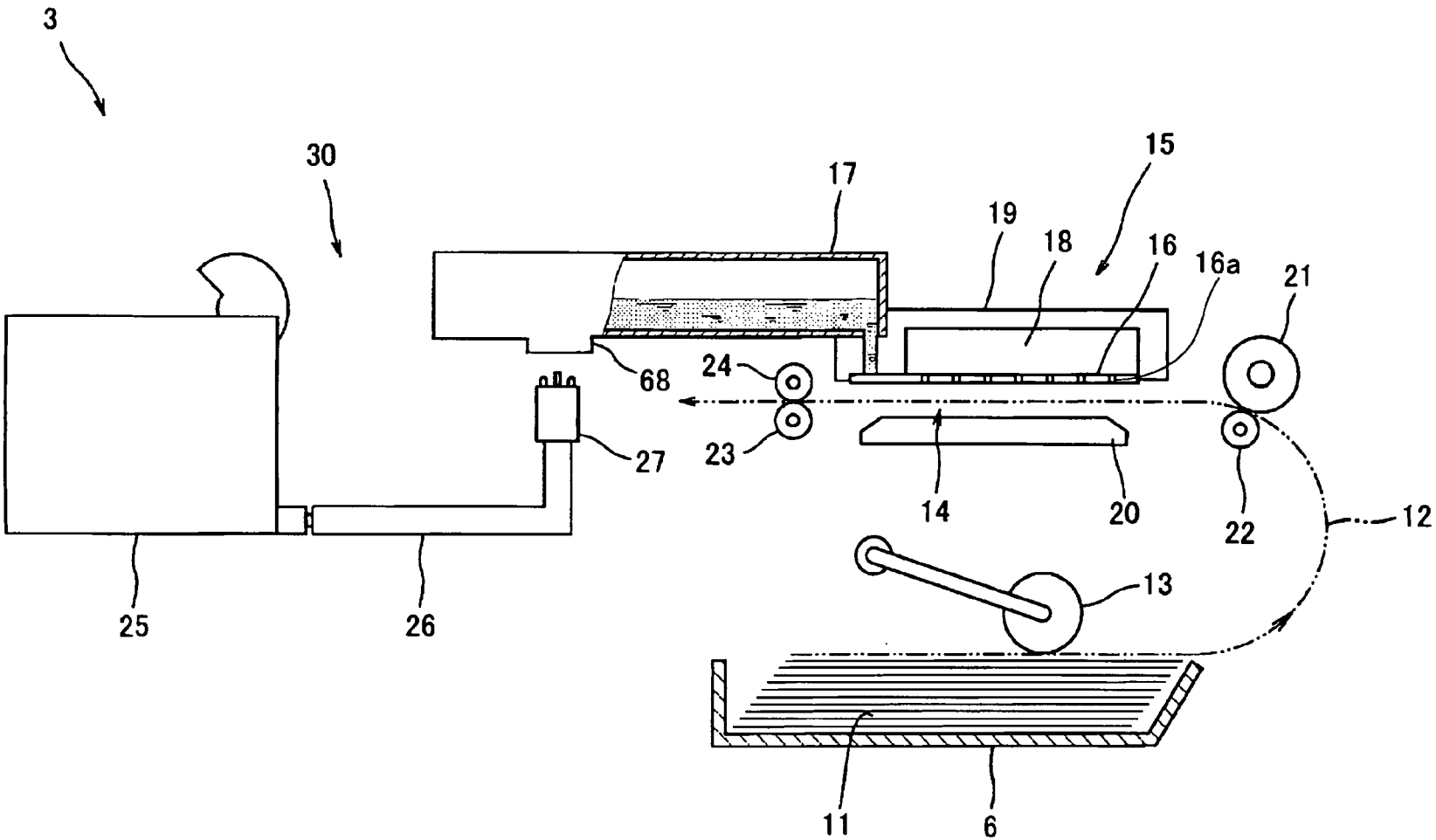
FIG. 2 shows a schematic cross-sectional view of the ink jet recording device.

FIG. 2 shows a schematic cross-sectional view of the ink jet recording device 3. The paper supply tray 6 is disposed at a bottom side of the multi function device 1. A paper supply driving roller 13 is disposed at an upper side of the paper supply tray 6. The paper supply driving roller 13 supplies an uppermost sheet of paper 11 stacked in the paper supply tray 6 to a feeding path 12. The feeding path 12 extends upwards from a back surface side of the paper supply tray 6 and then forms a U-turn to face toward a front surface side thereof. The feeding path 12 passes a printing region 14 and extends to the paper discharge tray 7 (see FIG. 1).

An image recording unit 15 is disposed in the printing region 14. A platen 20 that is larger than the paper size is disposed below the image recording unit 15. A feeding roller 21 and a pinch roller 22 are disposed at an upstream side of the image recording unit 15 along a paper transportation direction. The rollers 21 and 22 feed the paper 11 toward the platen 20. A paper discharge roller 23 and a pinch roller 24 are disposed at a downstream side of the image recording unit 15 along the paper transportation direction. The rollers 23 and 24 feed the paper 11 that has had an image printed thereon toward the paper discharge tray 7 (see FIG. 1).

The image recording unit 15 comprises a discharge head 16, a sub tank 17, a head controlling substrate 18, and a carriage 19. The discharge head 16 has a plurality of nozzle holes 16*a*. The discharge head 16 discharges ink towards the platen 20 from the nozzle holes 16*a*. The discharge head 16 may be a commonly known piezoelectric driven type. The sub tank 17 stores ink to be supplied to the discharge head 16. The head controlling substrate 18 controls the operation of the discharge head 16. The discharge head 16, sub tank 17, and head controlling substrate 18 are mounted on the carriage 19.

The sub tank 17 has a first joint part 68. The ink jet recording device 3 is provided with an ink replenishment mechanism 30. The first joint part 68 can be connected with the ink replenishment mechanism 30. Ink can be replenished into the sub tank 17 when the first joint part 68 and the ink replenishment mechanism 30 are in a connected state. The ink replenishment mechanism 30 is provided with a main tank 25, an ink supply tube 26, and a second joint part 27. The main tank 25 is housed detachably in the main tank mounting part 9 shown in FIG. 3. The main tank 25 is a cartridge type. One end of the ink supply tube 26 is connected with the main tank 25. The other end of the ink supply tube 26 is connected with the second joint part 27. The second joint part 27 is capable of moving in a vertical direction. The second joint part 27 is thus attached to and detached from the first joint part 68 of the sub tank 17. The second joint part 27 is connected to the first joint part 68 when the second joint part 27 is raised. In this state, the main tank 25 communicates with the sub tank 17 via the ink supply tube 26. That is, an ink replenishment path 26, 27*a*, 72 is in a connected state.

Figure 3:
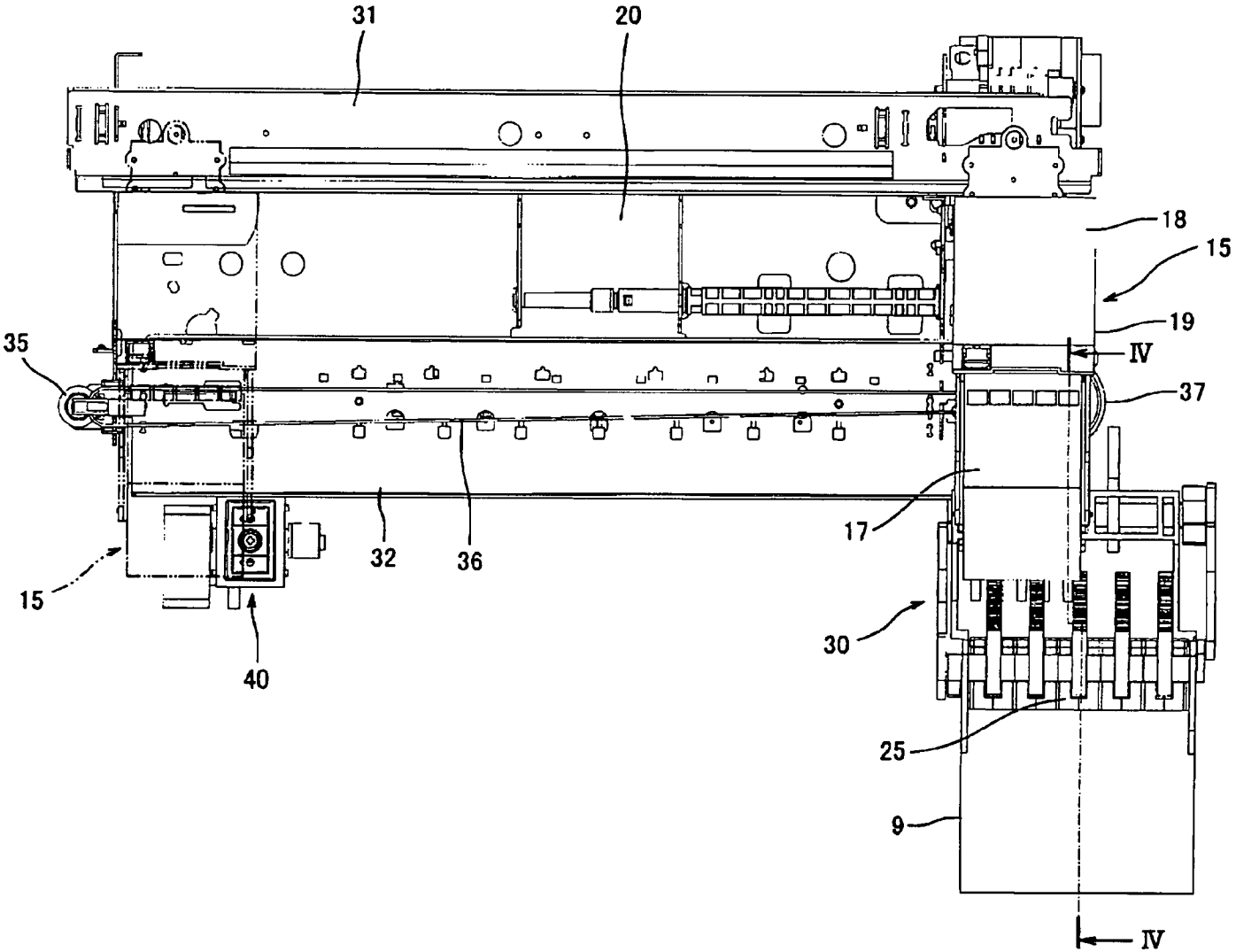
FIG. 3 shows a plan view of the ink jet recording device.

FIG. 3 shows a plan view of the ink jet recording device 3. A pair of guide rails 31 and 32 is disposed above the platen 20. The guide rails 31 and 32 have a flat plate shape. The guide rails 31 and 32 extend along a scanning direction that is orthogonal to a paper feeding direction (the up-down direction in FIG. 3). The guide rails 31 and 32 are formed on substantially the same plane. Upper surfaces of the guide rails 31 and 32 are substantially parallel to an upper surface of the platen 20, and are formed so as to be horizontal. The guide rails 31 and 32 support the carriage 19 of the image recording unit 15. The carriage 19 is capable of sliding in the direction in which the guide rails 31 and 32 extend (the left-right direction in FIG. 3).

A driving pulley (not shown) and a driven pulley 35 are disposed at the upper surface of the guide rail 32 that is located at the downstream side in the paper transportation direction. The driving pulley is disposed at one end part in the scanning direction. The driven pulley 35 is disposed at the other end part in the scanning direction. A ring shaped timing belt 36 is hung between the driving pulley and the driven pulley 35. A bottom part of the carriage 19 is fixed to a part of the timing belt 36. A motor 37 is connected to an axis of the driving pulley. The motor 37 causes the driving pulley to rotate. The timing belt 36 consequently rotates between the driving pulley and the driven pulley 35. When the timing belt 36 rotates, the carriage 19 moves along the guide rails 31 and 32. The carriage 19 can be made to move back and forth along the guide rails 31 and 32 by changing the direction of rotation of the motor 37. When the carriage 19 moves, the members mounted therein (the discharge head 16, the sub tank 17, and the head controlling substrate 18) move integrally with the carriage 19. The sub tank 17 has five ink storage chambers that correspond to the five colors of ink used in printing. Further, each of the ink storage chambers has a capacity capable of storing a greater amount of ink than that estimated to be consumed in one printing process.

The ink replenishment mechanism 30 and a maintenance mechanism 40 are disposed at an outer side of the printing region which the paper passes. The ink replenishment mechanism 30 is disposed at one end side in the scanning direction of the carriage 19 (the right side in FIG. 3). The ink replenishment mechanism 30 is disposed at a proximate side (the lower side in FIG. 3) of the guide rail 32. The ink replenishment mechanism 30 comprises the main tank mounting part 9. The main tank mounting part 9 is capable of housing five main tanks 25 corresponding to the five colors of ink.

Figure 4:
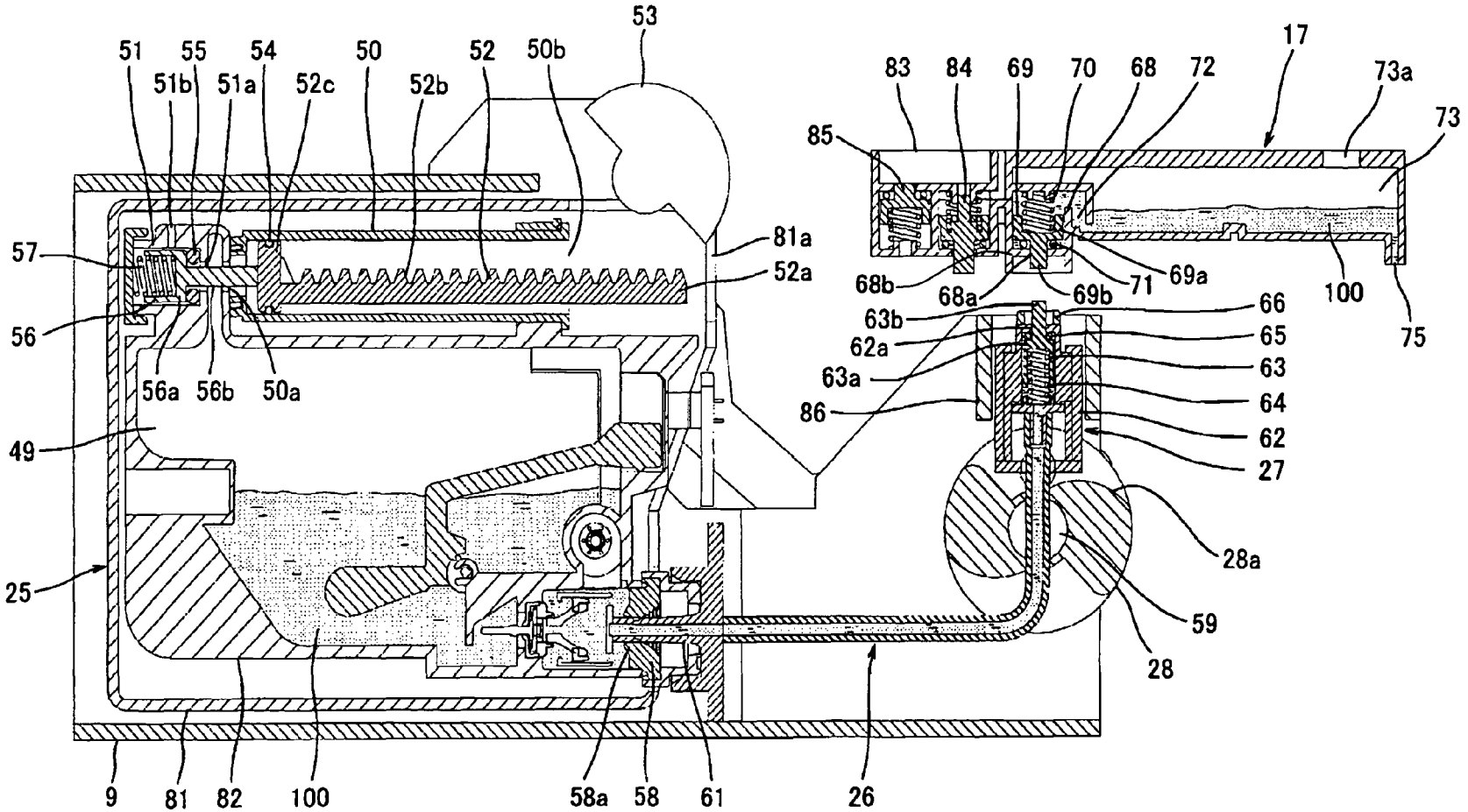
FIG. 4 shows a cross-sectional view along the line IV-IV of FIG. 3. An ink replenishment path is in a disconnected state.

FIG. 4 shows a cross-sectional view along the line IV-IV of FIG. 3. The main tank 25 has an outer case 81 and an inner case 82. The inner case 82 has an ink storage chamber 49 that stores ink 100. A piston pump chamber 50 and a positive pressure controlling chamber 51 are disposed above the ink storage chamber 49. The piston pump chamber 50 is disposed at the right side, and the positive pressure controlling chamber 51 is disposed at the left side. The piston pump chamber 50 communicates with an air layer in a top part of the ink storage chamber 49. A piston 52 is inserted into the piston pump chamber 50 in a manner capable of moving back and forth. The piston 52 comprises a rod part 52*a*, a rack gear part 52*b*, and a piston part 52*c*. The rod part 52*a* has a smaller diameter than the piston pump chamber 50. The rack gear part 52*b* is formed on an upper surface of the rod part 52*a*. The piston part 52*c* is disposed at a left end part of the rod part 52*a*. An O ring 54 is attached to the piston part 52*c*. The O ring 54 makes contact with an inner circumference surface of the piston pump chamber 50. Gas is consequently unable to pass between a right side and a left side of the O ring 54.

An insertion hole 50*a* and an opening part 50*b* are formed in the piston pump chamber 50. The insertion hole 50*a* is formed in a wall surface facing the positive pressure controlling chamber 51. The opening part 50*b* is formed in a wall surface at the other side from the insertion hole 50*a*. The opening part 50*b* allows the rod part 52*a* to pass therethrough. An opening part 81*a* is formed in the outer case 81. The opening part 81*a* is formed by making a notch in a wall surface of a sub tank side of the outer case 81. The opening part 81*a* is formed in a region corresponding to the opening part 50*b* of the piston pump chamber 50. Furthermore, a substantially half-circle shaped pinion gear 53 is disposed at an upper part of the main tank mounting part 9. The pinion gear 53 is driven to rotate by a driving means (not shown). The pinion gear 53 passes through the opening part 81*a* and meshes with the rack gear part 52*b*. That is, when the pinion gear 53 rotates, power is transmitted to the rack gear part 52*b*. The piston 52 can thus move back and forth.

A positive pressure controlling valve 56 is inserted into the positive pressure controlling chamber 51. The positive pressure controlling valve 56 is capable of moving back and forth in a left-right direction. The positive pressure controlling valve 56 comprises a base part 56*a* and a shaft part 56*b*. There is a clearance between the base part 56*a* and an inner circumference surface of the positive pressure controlling chamber 51. This clearance allows communication between the left side and the right side of the base part 56*a*. The shaft part 56*b* protrudes from the base part 56*a* toward the piston 52. A first atmosphere communication hole 51*a* is formed in the positive pressure controlling chamber 51. The first atmosphere communication hole 51*a* is formed in a wall surface facing the piston pump chamber 50. The first atmosphere communication hole 51*a* allows the shaft part 56*b* to pass therethrough. There is a clearance, in the first atmosphere communication hole 51*a*, between the shaft part 56*b* and the positive pressure controlling chamber 51. Further, the shaft part 56*b* passes through the insertion hole 50*a*. There is a clearance, in the insertion hole 50*a*, between the shaft part 56*b* and the piston pump chamber 50. A sealing ring 55 is attached to an inner surface of the positive pressure controlling chamber 51. The sealing ring 55 is disposed between the base part 56*a* and the wall facing the piston pump chamber 50. A coiled spring 57 makes contact with the base part 56*a* of the positive pressure controlling valve 56. The coiled spring 57 biases the base part 56*a* toward the sealing ring 55. Further, a second atmosphere communication hole 51*b* is formed in the positive pressure controlling chamber 51. The second atmosphere communication hole 51*b* is formed in an upper wall surface of the positive pressure controlling chamber 51. The sealing ring 55 is present between the first atmosphere communication hole 51*a* and the second atmosphere communication hole 51*b*. In a normal state there is no communication between the first atmosphere communication hole 51*a* and the second atmosphere communication hole 51*b* because the sealing ring 55 creates a seal between the base part 56*a* and the inner circumference surface of the positive pressure controlling chamber 51.

In the case where positive pressure equal to or above a predetermined value is generated in the ink storage chamber 49, the positive pressure controlling valve 56 separates from the sealing ring 55 against the biasing force of the coiled spring 57. The first atmosphere communication hole 51*a* and the second atmosphere communication hole 51*b* thus communicate. In this case, the ink storage chamber 49 communicates with the atmosphere via the first atmosphere communication hole 51*a* and the second atmosphere communication hole 51*b*. Further, the positive pressure controlling valve 56 separates from the sealing ring 55 against the biasing force of the coiled spring 57 even in the case where the piston 52 moves toward the positive pressure controlling chamber 51 and presses the shaft part 56*b*. In this case, as well, the first atmosphere communication hole 51*a* and the second atmosphere communication hole 51*b* communicate, and the ink storage chamber 49 communicates with the atmosphere.

A tube connecting part 58 capable of deforming elastically is disposed at a lower part of the main tank 25. The tube connecting part 58 has a ring shape. An ink hole 58*a* is formed in a center of the tube connecting part 58. The tube connecting part 58 contracts due to resilient force when there is no load, thus closing the ink hole 58*a*. A connecting terminal 61 is connected to one end part of the ink supply tube 26. The connecting terminal 61 is inserted into the tube connecting part 58. The ink supply tube 26 thus communicates with the ink storage chamber 49 of the main tank 25. The second joint part 27 is connected to the other end part of the ink supply tube 26.

The second joint part 27 has a casing 62 that communicates with the ink supply tube 26. An outlet hole 62*a* is formed in an upper wall of the casing 62. The outlet hole 62*a* is located in a position higher than an ink level within the main tank 25 even in the case where the second joint part 27 is located in its lowermost position. The positional relationship of the joint part 27 and the main tank mounting part 9 (the main tank 25) is adjusted such that the above positional relationship is achieved. A guiding cylindrical part 86 is formed integrally with the main tank mounting part 9. The casing 62 is capable of sliding in the vertical direction (up-down direction in FIG. 4) along an inner circumference surface of the guiding cylindrical part 86. A ring shaped sealing member 66 capable of deforming elastically is attached to an upper end surface of the casing 62. The sealing member 66 is disposed at the surroundings of the outlet hole 62*a*. A cam roller 28 is disposed below the casing 62. The cam roller 28 is connected to a driving shaft 59. The driving shaft 59 is connected with a driving source (not shown). When the driving shaft 59 rotates, the cam roller 28 rotates in a clockwise or anti-clockwise direction. The cam roller 28 has a cam surface 28*a*. The cam surface 28*a* smoothly changes the distance in a radial direction to the driving shaft 59. When the cam roller 28 rotates in an anti-clockwise direction from the state shown in FIG. 4, the cam surface 28*a* makes contact with a lower surface of the casing 62, and raises the second joint part 27. When the cam roller 28 rotates in a clockwise direction from the state where the second joint part 27 is in the raised position, the second joint part 27 descends along the cam surface 28*a*.

A second opening and closing valve 63 is inserted into the casing 62 in a manner capable of moving in the vertical direction. The second opening and closing valve 63 has a base part 63*a* and a shaft part 63*b*. There is a clearance between the base part 63*a* and an inner circumference surface of the casing 62. This clearance allows communication between an upper side and a lower side of the base part 63*a*. The shaft part 63*b* protrudes upward from the base part 63*a*. The shaft part 63*b* passes through the outlet hole 62*a*. There is a clearance, in the outlet hole 62*a*, between the shaft part 63*b* and the inner circumference surface of the casing 62. This clearance allows communication between an upper side and a lower side of the outlet hole 62*a*. A sealing ring 65 is attached to the inner circumference surface of the casing 62. The sealing ring 65 is disposed at the surroundings of the outlet hole 62*a*. The sealing ring 65 is disposed between the casing 62 and the base part 63*a* of the second opening and closing valve 63. A coiled spring 64 makes contact with the base part 63*a* of the second opening and closing valve 63. The coiled spring 64 biases the base part 63*a* toward the sealing ring 65. In a normal state (a state where the second joint part 27 is not making contact with the sub tank 17), the base part 63*a* makes contact with the sealing ring 65. An ink path 27*a* (see FIG. 6B) within the second joint part 27 is thus closed by the second opening and closing valve 63 because the sealing ring 65 creates a seal between the base part 63*a* and the inner circumference surface of the casing 62. The ink path 27*a* is formed in spaces between the casing 62 and the second opening and closing valve 63 (a space of the outlet hole 62*a*, a space between the sealing ring 65 and the second opening and closing valve 63, etc.). Moreover, when the base part 63*a* is making contact with the sealing ring 65, the shaft part 63*b* protrudes upward beyond the sealing member 66.

In the case where the shaft part 63*b* of the second opening and closing valve 63 is pushed back by resistance from a first opening and closing valve 69 (to be described), the second opening and closing valve 63 separates from the sealing ring 65 against the biasing force of the coiled spring 64. In this case, the ink path 27*a* within the second joint part 27 is opened. Further, an upper end of the shaft part 63*b* protrudes upward beyond the sealing member 66 even when the second opening and closing valve 63 is in a most retreated (lowered) state. In this state, the shaft part 63*b* is capable of pushing open the first opening and closing valve 69 (to be described).

The sub tank 17 comprises the first joint part 68, an ink storage chamber 73, etc. In the case where the multi function device 1 is viewed from a plan view, the first joint part 68 is disposed in a position that corresponds to (partially overlap with) the second joint part 27. The first joint part 68 has a case part 68*b* that is formed integrally with an outer wall of the sub tank 17. An ink path 72 is formed within the case part 68*b*. The ink path 72 communicates with the ink storage chamber 73. An outlet hole 75 is formed in a lower wall of the sub tank 17. Ink 100 within the ink storage chamber 73 is supplied from the outlet hole 75 to the discharge head 16 (see FIG. 2). A communication hole 73*a* is formed in an upper wall of the ink storage chamber 73. The sub tank 17 has a pressure buffering chamber 83. The pressure buffering chamber 83 is disposed at a left side of the first joint part 68. A resin film (not shown) is applied to an upper surface of the pressure buffering chamber 83 and the ink storage chamber 73. The pressure buffering chamber 83 and the ink storage chamber 73 thus maintain an airtight state. The pressure buffering chamber 83 communicates with the ink storage chamber 73 via a gas path (not shown) that reaches the communication hole 73*a*. The pressure buffering chamber 83 has a negative pressure controlling valve 84 and a positive pressure controlling valve 85. In the case where negative pressure equal to or above a predetermined value has occurred in the pressure buffering chamber 83, the negative pressure controlling valve 84 causes the pressure buffering chamber 83 to communicate with the atmosphere. In the case where positive pressure equal to or above a predetermined value has occurred in the pressure buffering chamber 83, the positive pressure controlling valve 85 causes the pressure buffering chamber 83 to communicate with the atmosphere.

An inlet hole 68*a* is formed in a lower wall of the case part 68*b*. Further, the first joint part 68 comprises the first opening and closing valve 69. The first opening and closing valve 69 is inserted into the case part 68*b*. The first opening and closing valve 69 is capable of moving in the vertical direction along the case part 68*b*. The first opening and closing valve 69 has a base part 69*a* and a shaft part 69*b*. There is a clearance between the base part 69*a* and an inner circumference surface of the case part 68*b*. This clearance allows communication between an upper side and a lower side of the base part 69*a*. Further, the shaft part 69*b* protrudes downward from the base part 69*a*. In the inlet hole 68*a*, there is a clearance between the shaft part 69*b* and the inner circumference surface of the case part 68*b*. This clearance allows communication between an upper side and a lower side of the inlet hole 68*a*.

The shaft part 69*b* of the first opening and closing valve 69 and the shaft part 63*b* of the second opening and closing valve 63 are formed on the same axis. The shaft part 69*b* and the shaft part 63*b* face one another. A sealing ring 71 is attached to the inner circumference surface of the case part 68*b*. The sealing ring 71 is disposed at the surroundings of the inlet hole 68*a*. The sealing ring 71 is disposed between the case part 68*b* and the base part 69*a* of the first opening and closing valve 69. A coiled spring 70 makes contact with the base part 69*a* of the first opening and closing valve 69. The coiled spring 70 biases the base part 69*a* toward the sealing ring 71. That is, the first opening and closing valve 69 and the second opening and closing valve 63 are biased by the coiled springs 64 and 70 in a direction of approaching one another. In the normal state (the state where the second joint part 27 is not making contact with the sub tank 17), the base part 69*a* makes contact with the sealing ring 71. The ink path 72 within the first joint part 68 is thus closed by the first opening and closing valve 69 because the sealing ring 71 creates a seal between the base part 69*a* and the inner circumference surface of the case part 68*b*. The ink path 72 is formed in spaces between the case part 68*b* and the first opening and closing valve 69 (a space of the inlet hole 68*a*, a space between the sealing ring 71 and the first opening and closing valve 69, etc.). Moreover, the spring constant of the coiled spring 70 of the first joint part 68 is greater than the spring constant of the coiled spring 64 of the second joint part 27. As a result, when the shaft parts 63*b* and 69*b* strike against one another, the second opening and closing valve 63 is pushed downward by the shaft part 69*b*.

Figure 5:
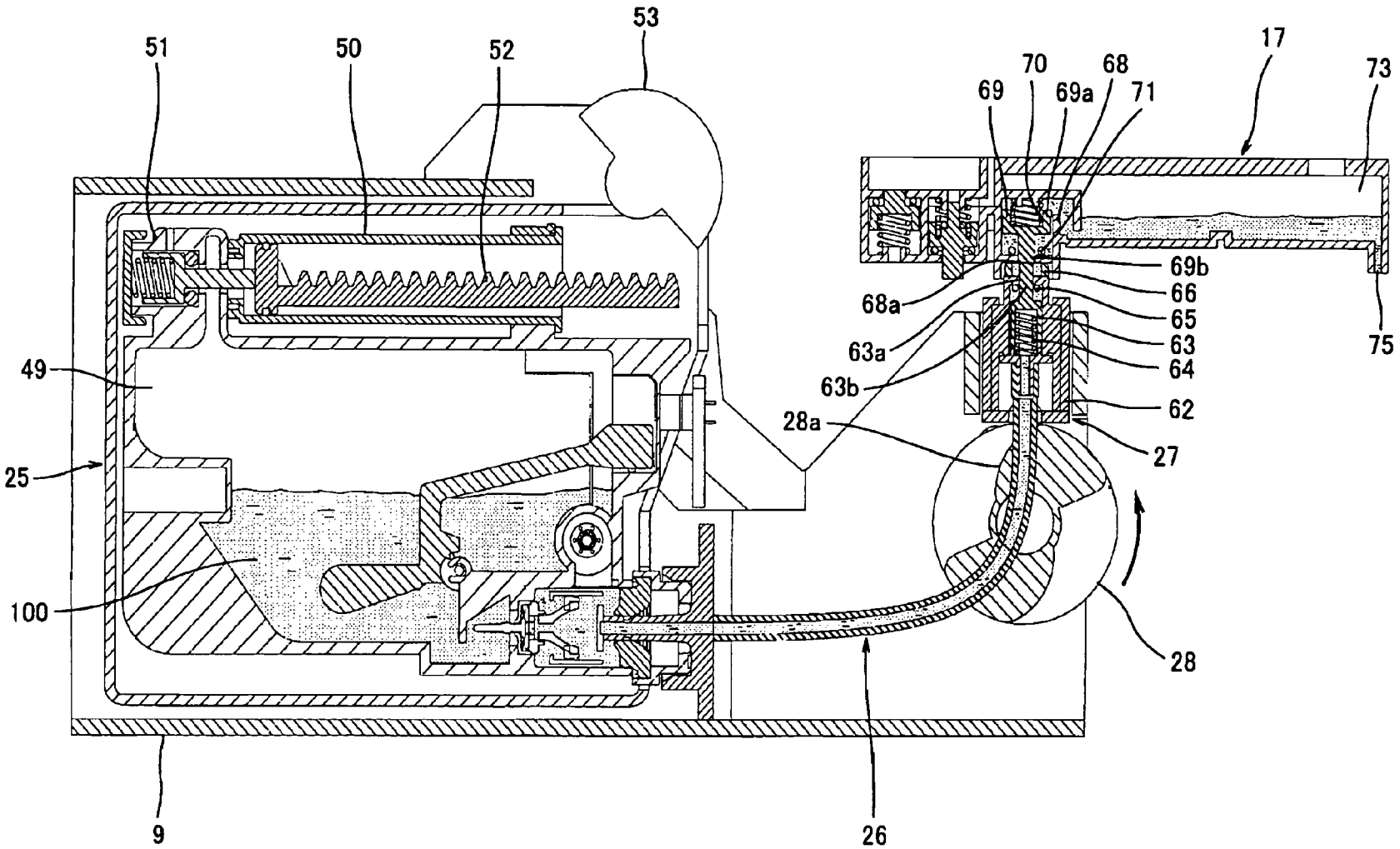
FIG. 5 shows a cross-sectional view of the ink jet recording device. The ink replenishment path is in a connected state.

Next, an ink replenishment operation will be described. FIG. 5 shows the first joint part 68 and the second joint part 27 in a connected state. FIG. 5 corresponds to the same cross-sectional view as in FIG. 4. When the cam roller 28 is rotated in the anti-clockwise direction from the state in FIG. 4, the second joint part 27 is raised. The sealing member 66 makes contact with the surroundings of the inlet hole 68*a* in a lower surface of the first joint part 68. Further, the shaft part 63*b* of the second opening and closing valve 63 makes contact with the shaft part 69*b* of the first opening and closing valve 69. After the ink path 27*a* of the second joint part 27 has opened, the ink path 72 of the first joint part 68 opens. This point will be described in detail next with reference to FIGS. 6A to 6C.

Figure 6C:
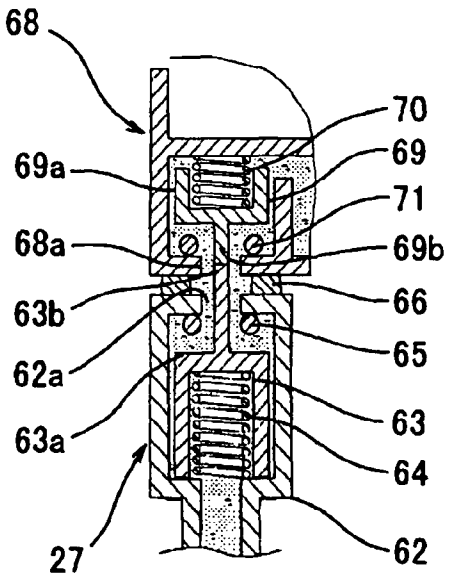
FIG. 6C shows the first and the second joint parts after the connection operation has ended.
Figure 6B:
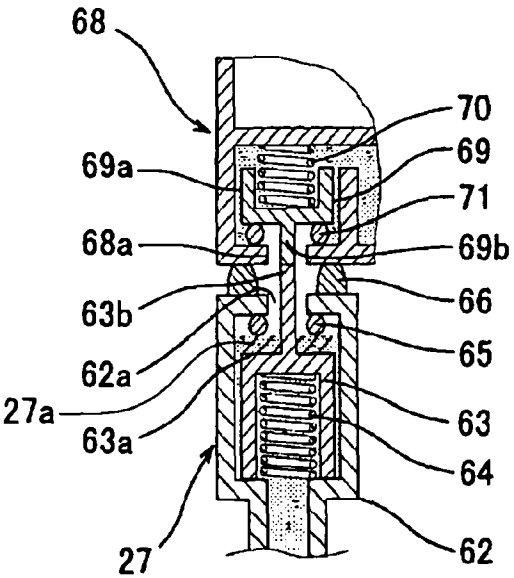
FIG. 6B shows the first and the second joint parts after a connection operation has begun.
Figure 6A:
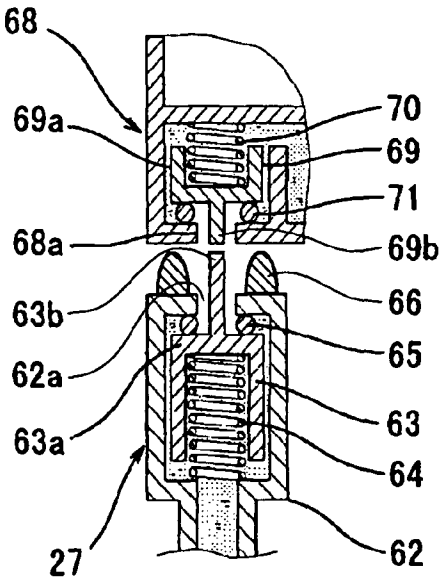
FIG. 6A shows a first and a second joint part prior to connection.

FIG. 6A shows the first and the second joint parts 68 and 27 prior to connection. FIG. 6B shows the first and the second joint parts 68 and 27 after a connection operation has begun. FIG. 6C shows the first and the second joint parts 68 and 27 after the connection operation has ended. As shown in FIG. 6A and FIG. 6B, when the second joint part 27 moves upward, the sealing member 66 makes contact with the first joint part 68. The sealing member 66 fits with the surroundings of the inlet hole 68*a* of the first joint part 68, thus maintaining an air-tight state of the ink replenishment path 26, 27*a*, 72. Next, the shaft parts 69*b* and 63*b* of the first and second opening and closing valves 69 and 63 are pushed together. The spring constant of the coiled spring 64 of the second opening and closing valve 63 is less than the spring constant of the coiled spring 70 of the first opening and closing valve 69. As a result, the second opening and closing valve 63 is opened earlier than the first opening and closing valve 69. That is, the ink path 27*a* of the second joint part 27 is opened earlier than the ink path 72 of the first joint part 68. Since the sealing member 66 is compressed and deforms, air present between the first joint part 68 and the second joint part 27 is compressed. This compressed air enters the ink path 27*a* of the second joint part 27 that was opened first. The compressed air is thus prevented from entering the ink path 72 of the first joint part 68. Further, the sealing member 66 is fitted with the sub tank 17 at the moment when the second opening and closing valve 63 is opened. That is, the ink replenishment path 26, 27*a*, 72 is cut off from the atmosphere. As a result, a large amount of atmosphere does not enter the second joint part 27 while the second opening and closing valve 63 is released. Air having a large amount of positive pressure that is present between the first joint part 68 and the second joint part 27 enters the second joint part 27. As a result, in the case where ink has adhered to the vicinity of the outlet hole 62*a*, this ink can be drawn by the compressed air into the second joint part 27.

In FIG. 6C, the second opening and closing valve 63 is at a lowermost position. That is, a lower end of the second opening and closing valve 63 is making contact with the casing 62. When, in this state, the second joint part 27 is raised further, the shaft part 69*b* of the first opening and closing valve 69 is pushed upward by the shaft part 63*b* of the second opening and closing valve 63. The first opening and closing valve 69 is thus opened. That is, the ink path 72 of the first joint part 68 is opened, and the main tank 25 and the sub tank 17 thereby communicate. That is, the ink replenishment path 26, 27*a*, 72 is in a connected state.

Figure 7:
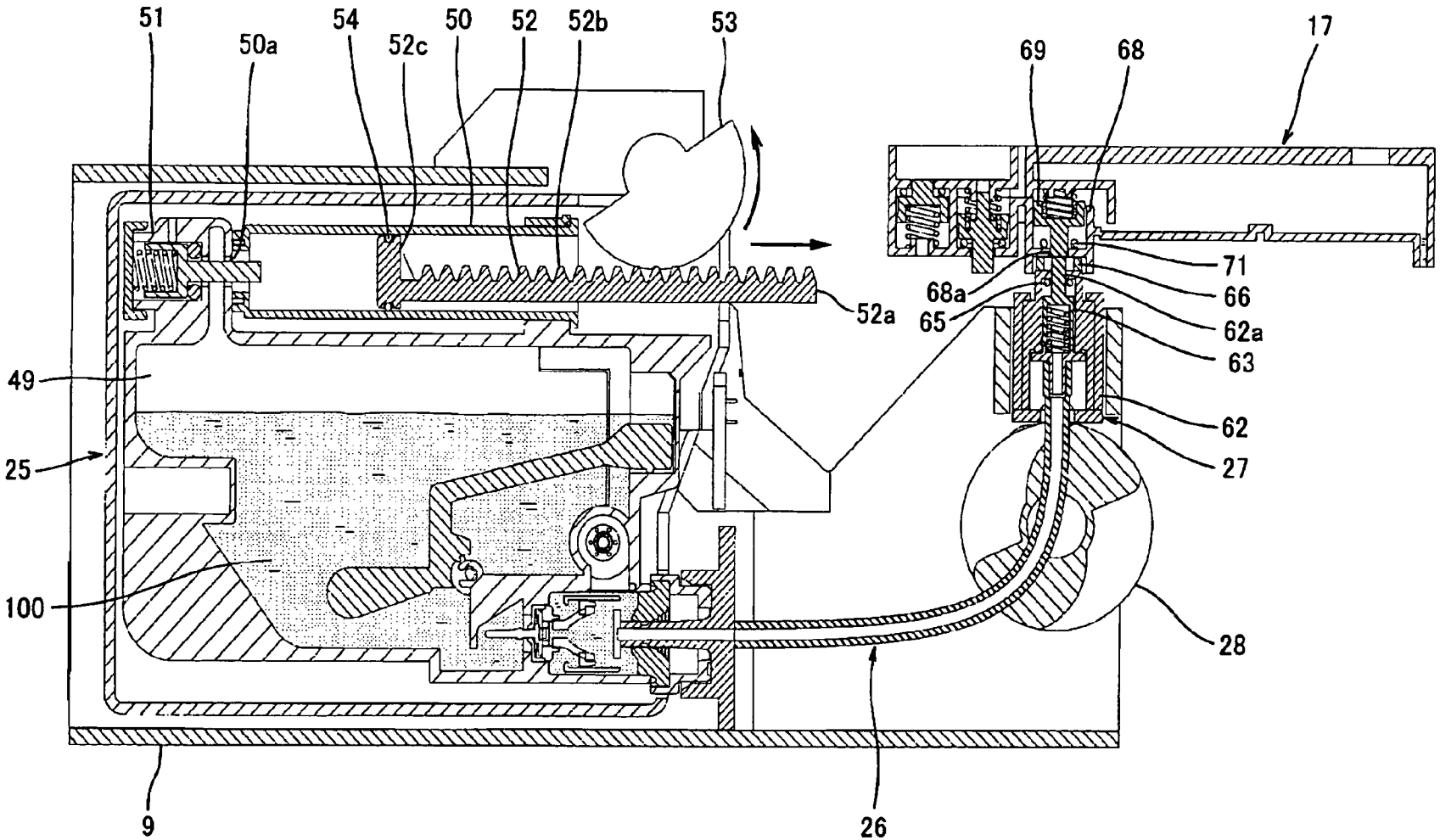
FIG. 7 shows a cross-sectional view of the ink jet recording device. A figure is shown for describing how ink returns from a sub tank to a main tank.

FIG. 7 is a figure for describing how ink returns from the sub tank 17 to the main tank 25. FIG. 7 corresponds to the same cross-section as FIG. 4. A driving source (not shown) causes the pinion gear 53 of the main tank 25 to rotate in an anti-clockwise direction. The piston 52 is thus moved away from the insertion hole 50*a*. Negative pressure is formed in the ink storage chamber 49 of the main tank 25. The ink within the sub tank 17 is sucked by this negative pressure into the main tank 25 via the ink supply tube 26.

Figure 8:
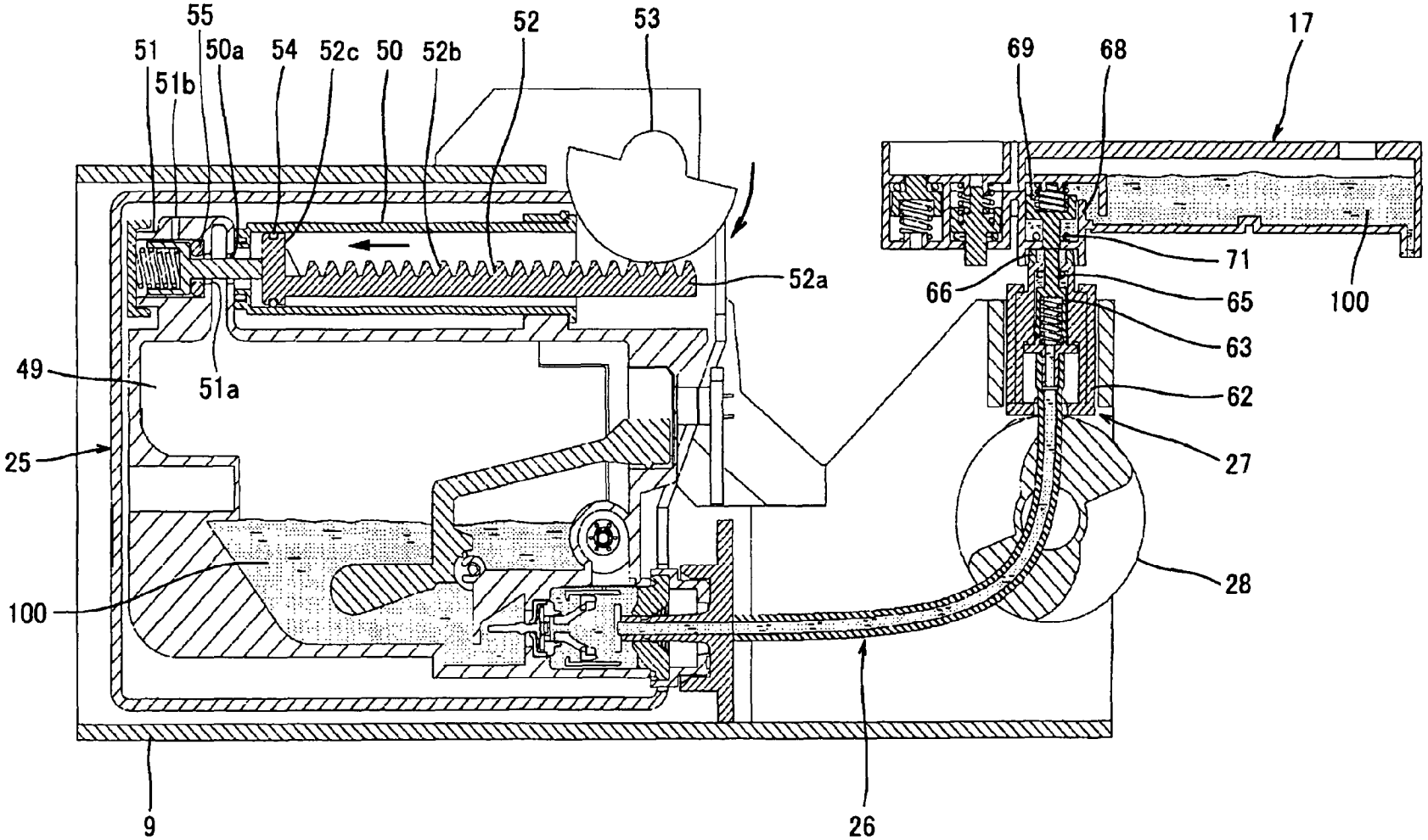
FIG. 8 shows a cross-sectional view of the ink jet recording device. A figure is shown for describing how ink is replenished from the main tank to the sub tank.

FIG. 8 is a figure for describing how ink is replenished from the main tank 25 to the sub tank 17. FIG. 8 corresponds to the same cross-section as FIG. 4. When the pinion gear 53 of the main tank 25 rotates in a clockwise direction, the piston 52 moves towards the insertion hole 50*a*. Positive pressure is formed in the ink storage chamber 49 of the main tank 25. The ink within the ink storage chamber 49 of the main tank 25 is supplied by this positive pressure to the sub tank 17 via the ink supply tube 26. The amount of ink replenished into the sub tank 17 at this juncture is set to be an amount of ink equal to or greater than the amount estimated to be consumed in the next printing operation. The piston 52 is not at a leftmost position in the state shown in FIG. 8. In this state, the sealing ring 55 is functioning, and the first atmosphere communication hole 51*a* and the second atmosphere communication hole 51*b* are not communicating.

Figure 9:
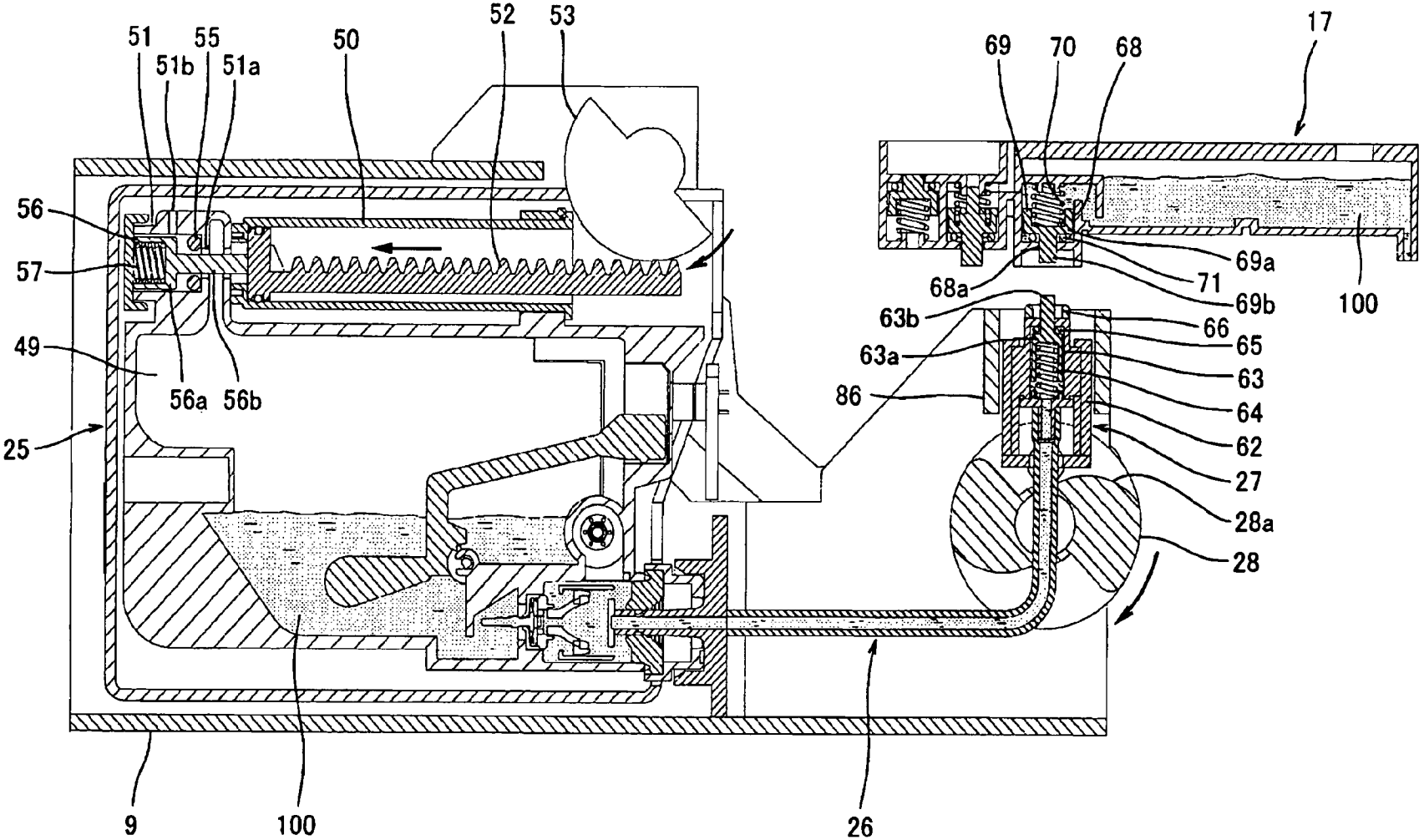
FIG. 9 shows a cross-sectional view of the ink jet recording device. A state is shown in which ink replenishment has been completed.

FIG. 9 shows a state in which the ink replenishment of the sub tank 17 has been completed. FIG. 9 corresponds to the same cross-section as FIG. 4. When the ink replenishment of the sub tank 17 has been completed, the cam roller 28 rotates in the clockwise direction, and the second joint part 27 is lowered. The lower surface of the first joint part 68 and the sealing member 66 of the second joint part 27 thus separate, and the shaft part 63*b* of the second opening and closing valve 63 and the shaft part 69*b* of the first opening and closing valve 69 thus separate. First, the base part 69*a* of the first opening and closing valve 69 fits with the sealing ring 71 due to the biasing force of the coiled spring 70, and the first opening and closing valve 69 is closed. That is, the ink path 72 of the first joint part 68 is closed. Next, the base part 63*a* of the second opening and closing valve 63 fits with the sealing ring 65 due to the biasing force of the coiled spring 64, and the second opening and closing valve 63 is closed. That is, the ink path 27*a* of the second joint part 27 is closed. The ink path 27*a* of the second joint part 27 is closed after the ink path 72 of the first joint part 68 has been closed. This point will be described in detail next with reference to FIGS. 10A to 10C.

Figure 10C:
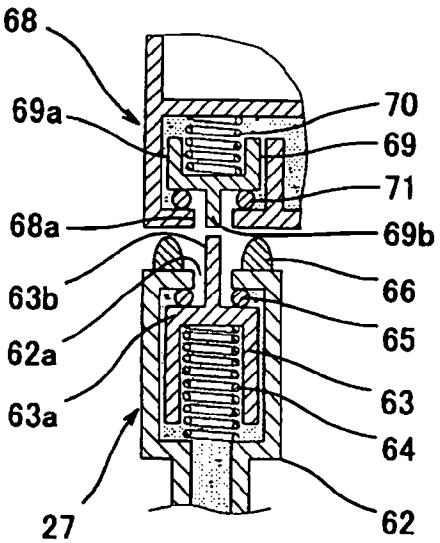
FIG. 10C shows the first and the second joint parts after the disconnection operation has ended.
Figure 10B:
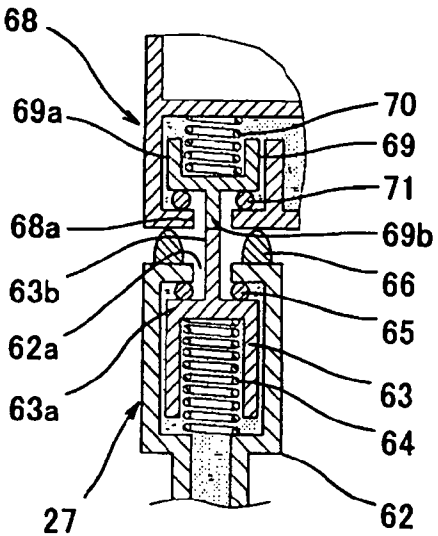
FIG. 10B shows the first and the second joint parts after the disconnection operation has progressed further from the state in FIG. 10A.
Figure 10A:
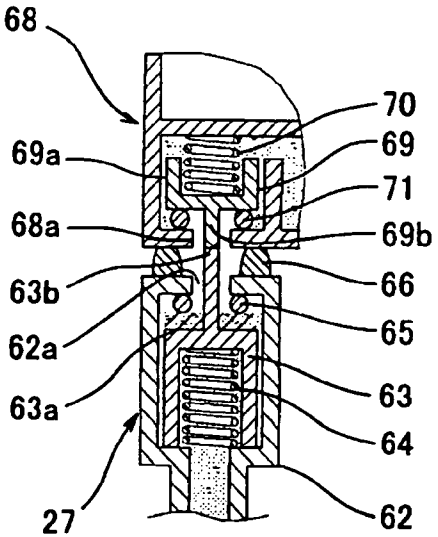
FIG. 10A shows the first and the second joint parts immediately after a disconnection operation has begun.

FIG. 10A shows the first and the second joint parts 68 and 27 immediately after a disconnection operation has begun. FIG. 10B shows the first and the second joint parts 68 and 27 after the disconnection operation has progressed further from the state in FIG. 10A. FIG. 10C shows the first and the second joint parts 68 and 27 after the disconnection operation has ended. The spring constant of the coiled spring 70 of the first opening and closing valve 69 is greater than the spring constant of the coiled spring 64 of the second opening and closing valve 63. As a result, as shown in FIG. 10A, when the second joint part 27 is lowered from the connected state, the first opening and closing valve 69 is closed earlier than the second opening and closing valve 63. The sealing member 66 is still compressed in the state shown in FIG. 10A. As a result, the sealing member 66 expands when the second joint part 27 is lowered further from the state in FIG. 10A. At this juncture, air present between the first joint part 68 and the second joint part 27 expands, and negative pressure is formed. However, this negative pressure does not enter the first joint part 68 because the first opening and closing valve 69 has already been closed. The negative pressure enters the second joint part 27 that has not yet been closed.

With the configuration of the present embodiment, a large amount of positive pressure is prevented from passing into the sub tank 17 at the time when the first and the second joint parts 68 and 27 are connected. It is thus possible to prevent the destruction of the meniscus of the nozzle holes 16A of the discharge head 16 that communicates with the sub tank 17. Further, it is possible to prevent a large amount of negative pressure from passing into the sub tank 17 at the time when the first and the second joint parts 68 and 27 are disconnected. It is thus possible to prevent the destruction of the meniscus of the nozzle holes 16A of the discharge head 16 that communicates with the sub tank 17.

Further, the outlet hole 62*a* of the second joint part 27 opens upward. As a result, even in the case where ink has adhered to the surroundings of the outlet hole 62*a* of the second joint part 27, this ink is easily sucked by self weight into the second joint part 27 from the outlet hole 62*a*. The ink that has adhered to the surroundings of the outlet hole 62*a* of the second joint part 27 can thus be prevented from running down to the exterior.

Further, there is a possibility that an ink film may be formed within the sealing member 66 when a ring shaped sealing member 66 is utilized. If the sealing member 66 were attached to the first joint part 68, the ink film formed within the sealing member 66 might run down when the first and the second joint parts 68 and 27 are not connected. In the present embodiment, however, the sealing member 66 is attached to the second joint part 27. It is consequently possible to prevent the ink film formed within the sealing member 66 from running down. However, this description does not necessarily forbid the sealing member 66 from being attached to the first joint part 68. The sealing member 66 may equally well be attached to the first joint part 68.

Second Embodiment

Figure 11C:
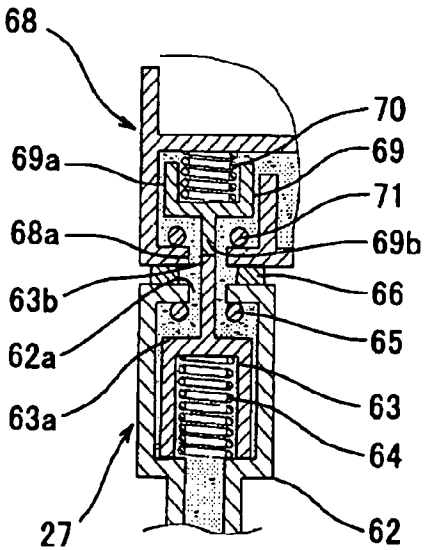
FIG. 11C shows the first and the second joint parts after the connection operation has ended.
Figure 11B:
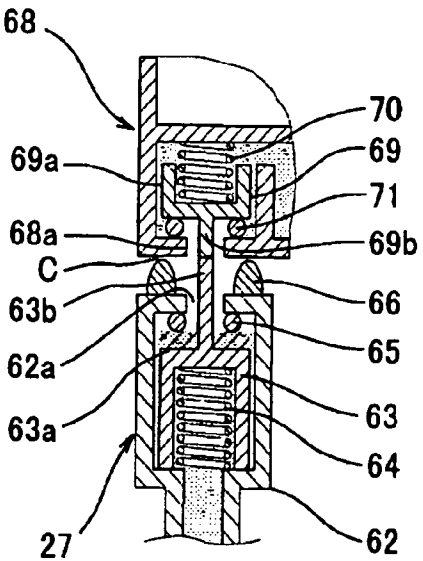
FIG. 11B shows the first and the second joint parts immediately after a connection operation has begun.
Figure 11A:
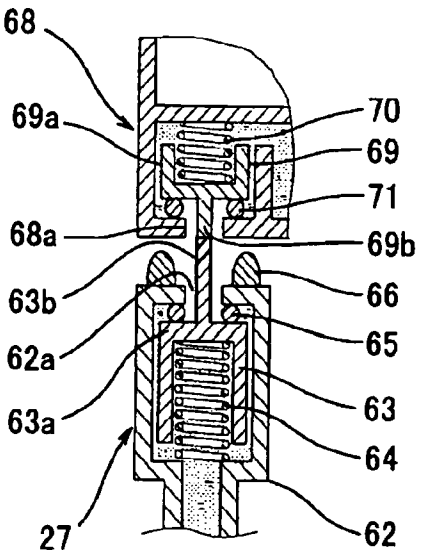
FIG. 11A shows a first and a second joint part of another embodiment prior to connection.

FIGS. 11A to 11C are figures for describing how the first and the second joint parts 68 and 27 are connected. FIG. 11A shows the first and the second joint parts 68 and 27 prior to connection. FIG. 11B shows the first and the second joint parts 68 and 27 immediately after the connection operation has begun. FIG. 11C shows the first and the second joint parts 68 and 27 after the connection operation has ended. When the second joint part 27 rises from the state of FIG. 11A, the second opening and closing valve 63 is opened first, as shown in FIG. 11B. In this state, a clearance C is formed between the sealing member 66 and the first joint part 68. As a result, in the case where ink has adhered to the vicinity of the outlet hole 62*a* of the second joint part 27, this ink is smoothly sucked into the second joint part 27 together with the atmosphere when the second opening and closing valve 63 is opened. When the second joint part 27 rises further from the state of FIG. 11B, the first opening and closing valve 69 is opened as shown in FIG. 11C.

In the present embodiment, the clearance C is formed between the sealing member 66 and the first joint part 68 at the moment when the second opening and closing valve 63 is opened. The inverse phenomenon occurs when the first joint part 68 and the second joint part 27 are disconnected. That is, the second opening and closing valve 63 is opened at the moment when the sealing member 66 separates from the first joint part 68. It could be said that a configuration has been adopted in which the sealing member 66 separates from the first joint part 68 while the second opening and closing valve 63 is being opened. In the present embodiment, the pinion gear 53 of the main tank 25 is rotated in a clockwise direction (see FIG. 9) prior to the sealing member 66 being separated from the first joint part 68 (or at the same time as this separation). The piston 52 thus moves toward the positive pressure controlling chamber 51, and the positive pressure controlling valve 56 releases the first atmosphere communication hole 51*a*. The first atmosphere communication hole 51*a* and the second atmosphere communication hole 51*b* thus communicate. As described above, the outlet hole 62*a* of the second joint part 27 is present at a position higher than the ink level within the main tank 25. The difference in water head caused thereby causes ink in the vicinity of the outlet hole 62*a* to return toward the main tank 25 when the second opening and closing valve 63 is released. Consequently, ink does not readily remain on an outer surface of the second joint part 27. It is consequently possible to prevent ink from dispersing into the printing region 14 when the disconnecting operation of the first and second joint parts 68 and 27 is performed.

Third Embodiment

Figure 12:
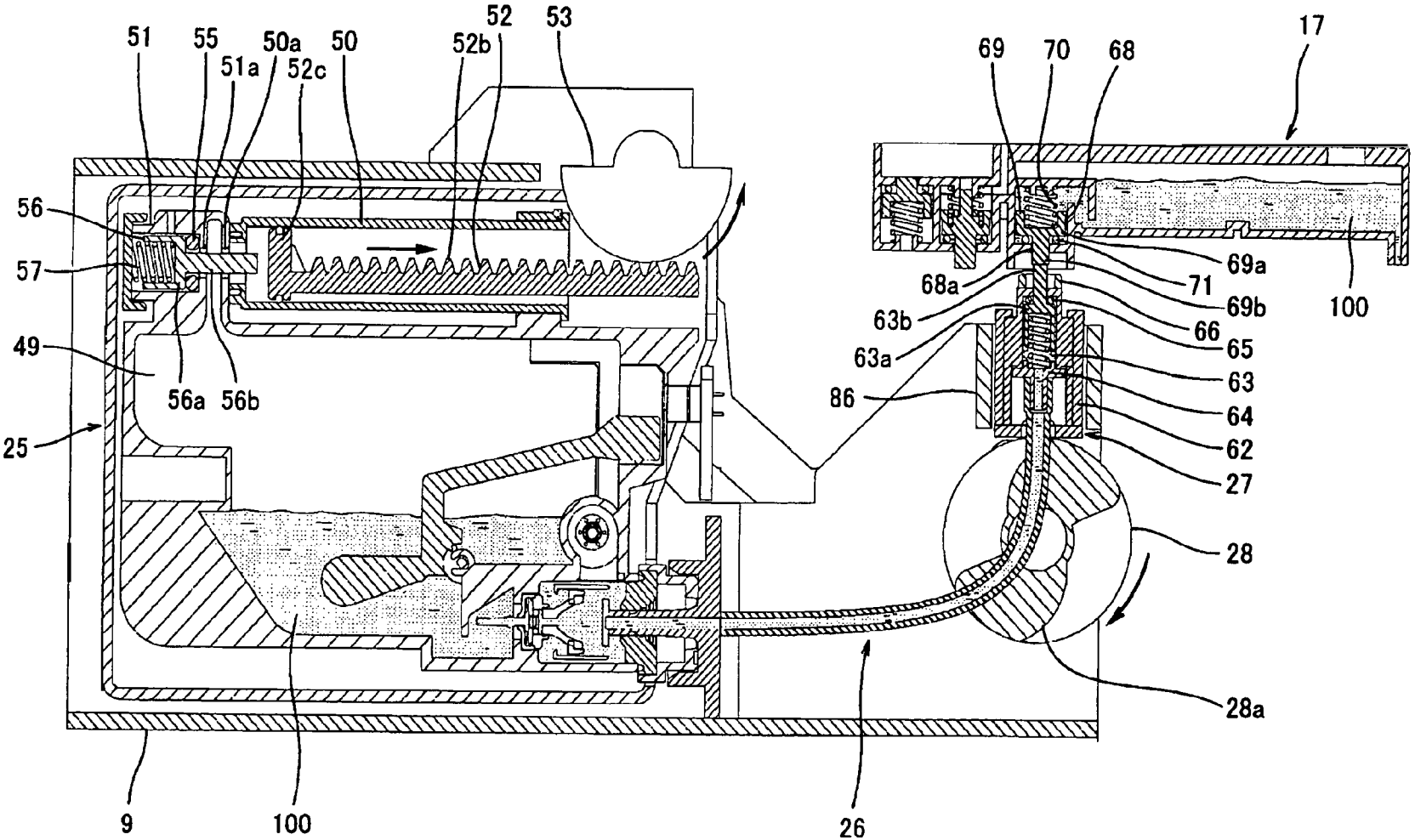
FIG. 12 shows a cross-sectional view of an ink jet recording device of another embodiment.

FIG. 12 is a figure for describing the disconnecting operation of the present embodiment. FIG. 12 corresponds to the same cross-section as FIG. 4. In the present embodiment, negative pressure is formed in the main tank 25 when the first and second joint parts 68 and 27 are disconnected. As in the first embodiment, the spring constant of the coiled spring 70 of the first opening and closing valve 69 is greater than the spring constant of the coiled spring 64 of the second opening and closing valve 63. As a result, when the second joint part 27 descends, the first opening and closing valve 69 closes earlier than the second opening and closing valve 63. Furthermore, as in the second embodiment, when the second joint part 27 descends further, the sealing member 66 separates from the first joint part 68 while the second opening and closing valve 63 is being opened. The pinion gear 53 of the main tank 25 is rotated in an anticlockwise direction prior to this separation (or at the same time as this separation). The piston 52 in the piston pump chamber 50 consequently moves away from the insertion hole 50*a*. Negative pressure is consequently formed in the ink storage chamber 49 of the main tank 25. When the sealing member 66 separates from the first joint part 68, the negative pressure causes ink in the vicinity of the outlet hole 62*a* to return toward the main tank 25. Consequently, ink does not readily remain on the outer surface of the second joint part 27. It is consequently possible to prevent ink from dispersing into the printing region 14 when the disconnecting operation of the first and second joint parts 68 and 27 is performed.

The technique set forth in the above embodiments may be applied to a liquid discharge device other than an ink jet recording device. For example, the technique set forth in the above embodiments may be applied to a device for discharging a solder to make a print circuit. Further, in the above embodiments, the sub tank 17 has been configured by forming the first joint part 68 and the ink storage chamber 73 integrally. However, the first joint part 68 and the ink storage chamber 73 may equally well be configured as separate parts. Further, in the above embodiments, the following two configurations are both used: the second opening and closing valve 63 is opened first while the first and second joint parts 68 and 27 are to be connected, and then the first opening and closing valve 69 is opened; and the first opening and closing valve 69 is closed first while the first and second joint parts 68 and 27 are to be disconnected, and then the second opening and closing valve 63 is closed. However, either of these configurations may equally well be utilized in isolation.

What is claimed is:

1. A liquid discharge device, comprising:

a discharge head comprising a nozzle for discharging liquid;

a sub tank capable of storing liquid to be supplied to the discharge head, the sub tank comprising a first member;

a liquid replenishment device comprising a main tank capable of storing liquid to be supplied to the sub tank, and a second member to be connected to the main tank, wherein the second member is capable of being connected to and disconnected from the first member, and the liquid within the main tank is to be supplied to the sub tank when the second member is in a connected state with the first member; and a seal member that seals between the first member and the second member when the second member is in the connected state with the first member;

wherein the first member comprises a first liquid path and a first valve biased in a direction where the first liquid path is closed;

wherein the second member comprises a second liquid path and a second valve biased in a direction where the second liquid path is closed;

wherein the first member and the second member are configured to open the second liquid path first, and then open the first liquid path in a case where the second member is to be connected to the first member;

wherein the main tank comprises:

a main tank hole located between an inner space in which the liquid is to be stored and the outside of the main tank; and a third valve capable of opening and closing the main tank hole;

wherein an opening of the second liquid path is located higher than a liquid level within the main tank; and wherein, when a state where the seal member seals changes into a state where the seal member does not seal, a state of the main tank hole changes from a closed state into an opened state.

2. The liquid discharge device as in claim 1;

wherein the first member and the second member are configured to close the first liquid path first, and then close the second liquid path in a case where the second member is to be disconnected from the first member.

3. The liquid discharge device as in claim 1;

wherein the second liquid path opens upward;

wherein the liquid replenishment device further comprises a movement device capable of moving the second member in a vertical direction; and wherein, in a case where the movement device moves the second member upward, the second member is connected to the first member.

4. The liquid discharge device as in claim 1;

wherein the seal member is coupled to the second member, and the seal member is configured to make contact with the first member when the second member is in the connected state with the first member.

5. The liquid discharge device as in claim 1, further comprising:

a negative pressure creation device capable of creating negative pressure within the main tank;

wherein, when the state where the seal member seals changes into a state where the seal member does not seal, a state of the negative pressure creation device changes from a state where the negative pressure creation device does not create negative pressure within the main tank into a state where the negative pressure creation device creates negative pressure within the main tank.

6. The liquid discharge device as in claim 1;

wherein, when a state where the second liquid path is closed changes into a state where the second liquid path is opened, a state of the seal member changes from the state where the seal member does not seal into the state where the seal member seals.

7. The liquid discharge device as in claim 1;

wherein, when a state where the second liquid path is closed changes into a state where the second liquid path is opened, a state of the seal member changes from the state where the seal member seals into the state where the seal member does not seal.

8. The liquid discharge device as in claim 1;

wherein the first member further comprises a first spring biasing the first valve toward the direction where the first liquid path is closed;

wherein the second member further comprises a second spring biasing the second valve toward the direction where the second liquid path is closed; and wherein the first member and the second member are configured such that the second liquid path is opened first by the first valve pushing the second valve against the spring force of the second spring, then the first liquid path is opened by the second valve pushing the first valve against the spring force of the first spring in the case where the second member is to be connected to the first member.

9. The liquid discharge device as in claim 8;

wherein the spring constant of the second spring is less than the spring constant of the first spring.

10. The liquid discharge device as in claim 9;

wherein the second member further comprises a casing in which the second liquid path is formed;

wherein the second valve is capable of moving along the casing between a first position in which the second liquid path is closed and a second position in which the second liquid path is opened;

wherein the casing is configured to prohibit the second valve from moving beyond the second position; and wherein the second valve in the second position protrudes beyond the casing toward the first member side.

11. A liquid discharge device, comprising:

a discharge head comprising a nozzle for discharging liquid;

a sub tank capable of storing liquid to be supplied to the discharge head, the sub tank comprising a first member; and a liquid replenishment device comprising a main tank capable of storing liquid to be supplied to the sub tank, and a second member to be connected to the main tank, wherein the second member is capable of being connected to and disconnected from the first member, and the liquid within the main tank is to be supplied to the sub tank when the second member is in a connected state with the first member;

a seal member that seals between the first member and the second member when the second member is in the connected state with the first member;

wherein the first member comprises a first liquid path and a first valve biased in a direction where the first liquid path is closed;

wherein the second member comprises a second liquid path and a second valve biased in a direction where the second liquid path is closed;

wherein the first member and the second member are configured to close the first liquid path first, and then close the second liquid path in a case where the second member is to be disconnected from the first member;

wherein the main tank comprises:

a main tank hole located between an inner space in which the liquid is to be stored and the outside of the main tank; and a third valve capable of opening and closing the main tank hole;

wherein an opening of the second liquid path is located higher than a liquid level within the main tank; and wherein, when a state where the seal member seals changes into a state where the seal member does not seal, a state of the main tank hole changes from a closed state into an opened state.

* * * * *